United States Patent [19]

O'Neil, Jr. et al.

[11] Patent Number: 4,654,920

[45] Date of Patent: Apr. 7, 1987

[54] SPONGE MOP WITH SCRUBBER ATTACHMENT

[75] Inventors: William J. O'Neil, Jr.; Richard P. Burkhart, both of Cincinnati, Ohio

[73] Assignee: The Drackett Company, Cincinnati, Ohio

[21] Appl. No.: 843,526

[22] Filed: Mar. 24, 1986

[51] Int. Cl.[4] ..... A47L 13/12; A47L 13/144

[52] U.S. Cl. ..... 15/119 A; 15/118

[58] Field of Search ..... 15/105, 118, 119 R, 15/119 A, 121, 116 A

[56] References Cited

U.S. PATENT DOCUMENTS 4,491,998 1/1985 Wilson et al. ..... 15/119 A 4,604,767 8/1986 Burkhart et al. ..... 15/119 A

FOREIGN PATENT DOCUMENTS 775135 5/1957 United Kingdom ..... 15/119 A

*Primary Examiner*—Edward L. Roberts

*Attorney, Agent, or Firm*—G. Warzecha

[57] ABSTRACT

A scrubber attachment for being fixedly mounted to a wringer type sponge mop without the necessity for any extra, attaching hardware. The scrubber attachment carries a scrubber pad and is fixedly secured to the mop head at a predetermined angle. This combination yields a mop capable of both conventional sponge cleaning and of abrasively rubbing to effect further cleansing treatment of a surface without the risk of moving the scrubber out of operative position during use.

9 Claims, 5 Drawing Figures

SPONGE MOP WITH SCRUBBER ATTACHMENT

This invention relates to wringer mops and more particularly to a wringer mop which is provided with a scrubber pad attachment to thereby enable the mop to be used to perform the dual function of washing a floor with a mop in the normal manner, and alternatively to remove soil resistant to removal by washing by applying an abrasive surface to the floor or wall being worked upon.

Wringer mops are already known and have evolved into a variety of forms. Such mops may be found, for example, in the following U.S. Pat. Nos. 210,953 issued to McCarthy, 2,201,079 issued to Camden, 2,203,106 issued to Rogers, 3,289,233 issued to Smyth, 3,727,259 issued to Wilson, 4,196,488 issued to Barry, 4,438,540 issued to Senour, 4,439,885 issued to Klotz and 4,491,998 issued to Wilson et al. In a typical wringer mop construction, such as those illustrated in several of the patents noted above, a mop is defined by a handle which carries at one end a mop head, the mop head carrying a sponge with the construction being such that the sponge may be squeezed to wring it out and make it ready for a fresh infusion of a cleaning liquid or to rid it of dirty liquid. With the exception of the construction illustrated by the Camden and Wilson et al. patents, wringer mops of the type carrying compressible sponges are suitable for a single purpose only. Namely, these mops carry no supplementary devices for performing any other function. In the construction illustrated in the Camden patent, a wiper blade may be attached for further wiping of a liquid from a surface being cleaned. The Wilson et al. patent discloses a rotatable scrubber attachment affixed to a wringer mop. While such attachments enable the mop to be used for both a mopping and scrubbing function, the rotatable scrubber attachment is not capable of repeated, continuous vigorous application due to the nature of the engagement between the pivot arms forming the scrubber attachment and the rollers which drive the pivot arms. Vigorous scrubbing would cause the scrubber attachment to move out of proper scrubbing position.

Some prior art is known disclosing a wringer mop in combination with a brush or wiper blade (Belgian Pat. No. 532,768). This device, however, is quite complex since it requires additional elements (nuts and bolts, etc.) to attach the brush to the yoke. Furthermore, this patent does not disclose or suggest means for enabling the use of elongated brushes or scrubber strips.

It is accordingly an object of this invention to produce a scrubber attachment for a wringer mop so that the scrubber attachment may be fixedly mounted to the mop head. It is a further object of this invention to produce such a device which may be attached to the mop head without the necessity for any additional hardware or other elements. It is yet another object to produce such a device which includes a lateral support member so the scrubber attachment may incorporate an elongated scrubber pad.

According to the practice of this invention in a wringer mop of the type shown generally by the Wilson and Barry patents noted above (hereby incorporated by reference), a scrubber attachment is provided, the attachment carrying a scrubber pad which may be detachable. In normal operation of the mop, the working face of the mop sponge is available for its usual surface contacting and washing function, with the scrubber pad being positioned at one side and rearwardly of the sponge working face. The scrubber pad is available for its intended function, i.e., the further cleaning as by abrasion or by rubbing of the surface being treated, when the mop is retracted so as to pull the sponge back into the mop head to thereby wring dirty liquid out of it and/or dry it. The scrubber pad may also be utilized when the working face of the mop sponge is not retracted.

IN THE DRAWINGS

Figure 1:
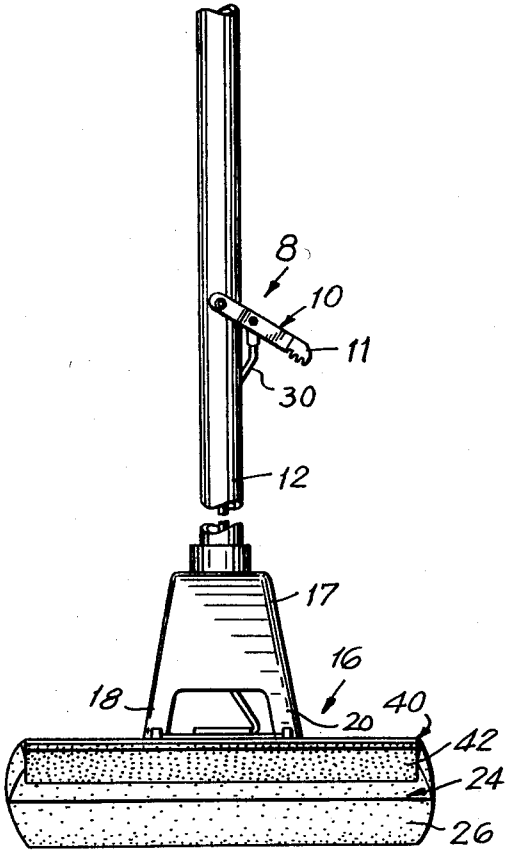
FIG. 1 is a front elevational view of the wringer mop and scrubber attachment of this invention, the mop being shown in its normal or use position.

Referring now to FIG. 1 of the drawings, the numeral 8 denotes generally the wringer mop and scrubber attachment of this invention, the mop including a retracting means 10, including a handle 11 and rod 30 for retracting the sponge of the mop (later to be described) from its normal position to a wringing position. The mop 8 includes an elongated handle 12, with a mop head 16 at its lower end.

Figure 3:
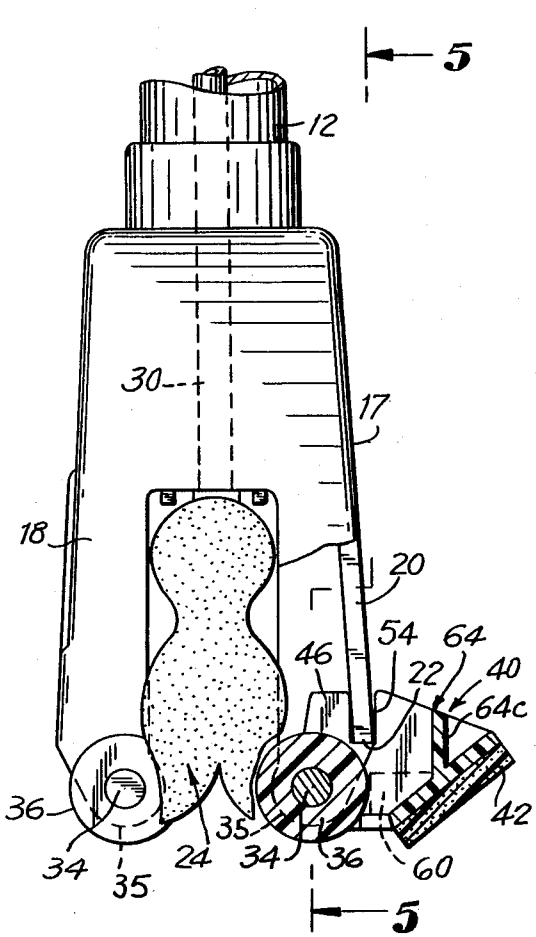
FIG. 3 is a view similar to FIG. 2, but showing the sponge in its retracted position.
Figure 2:
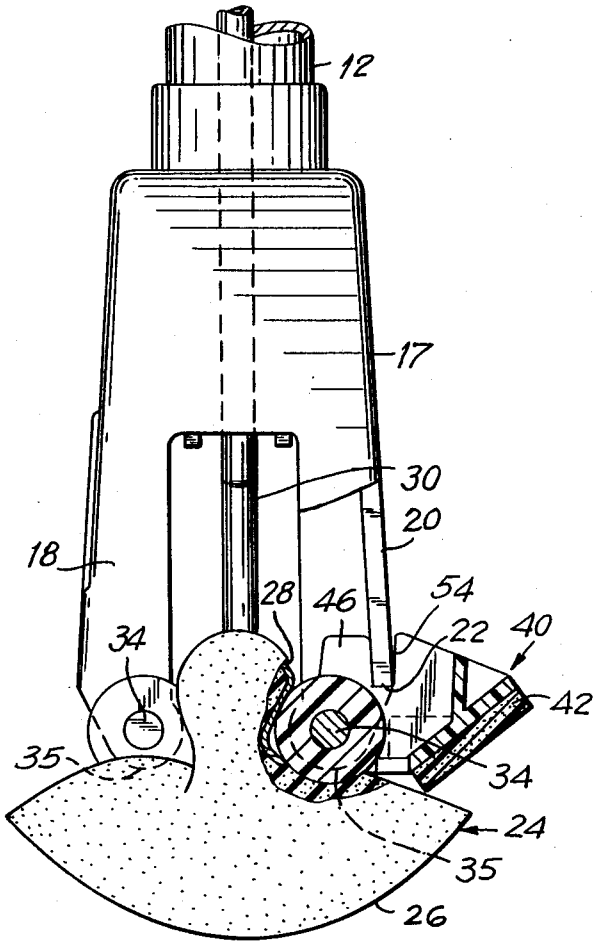
FIG. 2 is an end view of the mop of FIG. 1, partially broken away, to illustrate the relationship between the mop head, the sponge, and the scrubber attachment and the pad of this invention carried thereby.
Figure 5:
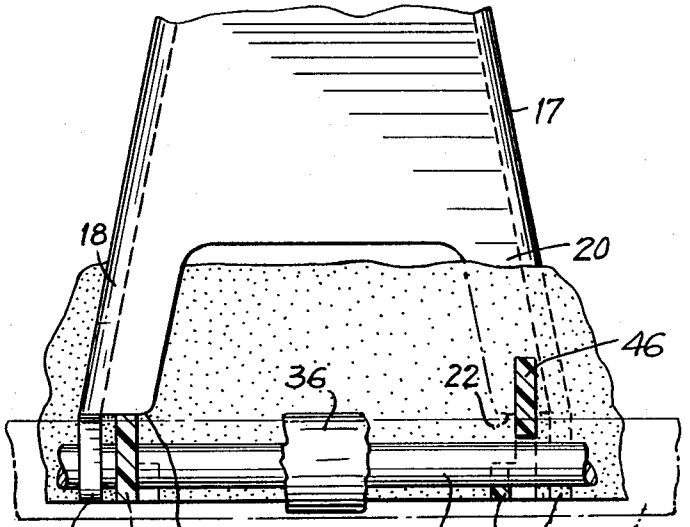
FIG. 5 is a cross-sectional view of the mop head shown in FIG. 3 taken along line 5—5.

Referring now also to FIGS. 2 and 3, the mop head 16 is defined by a generally U-shaped yoke 17, as formed of sheet metal or plastic, with each leg of the yoke being generally U-shaped in cross-section. The individual legs of the yoke are denoted respectively by the numerals 18 and 20, and it will be understood that each leg has, because of its U-shaped construction, two spaced extensions 35 for receiving therethrough the axles (described below), as best seen in FIG. 5. The numeral 24 denotes a sponge having a lower or working surface 26, the sponge being rigidly secured as by clamping to a rigid spine 28, the latter being fashioned, for example, of sheet metal.

The numerals 34 denote a pair of rigid axles, as in the form of a metal bar or shaft which runs through complementary apertures in the spaced extensions 35 in the ends of the legs 18 and 20 of the yoke. The numeral 36 denotes any one of a plurality of cylindrical or roller elements rotatably mounted and freely rotatable on axles 34. Rollers 36 extend longitudinally substantially the length of sponge 24 and are segmented to enable them to be aligned on an axle 34 while also allowing extensions 35 to be secured to the axles. The numeral 40 denotes generally the scrubber attachment and scrubber pad of this invention and includes a scrubber pad 42 fashioned of any desired abrasive material such as steel wool, sand paper, an elastomer impregnated with abrasive particles, or the like. The pad 42 may be affixed to the scrubber attachment by an adhesive or any other convenient means or, alternatively, the scrubber attachment may be provided with means by which replaceable scrubber pads may be employed.

Figure 4:
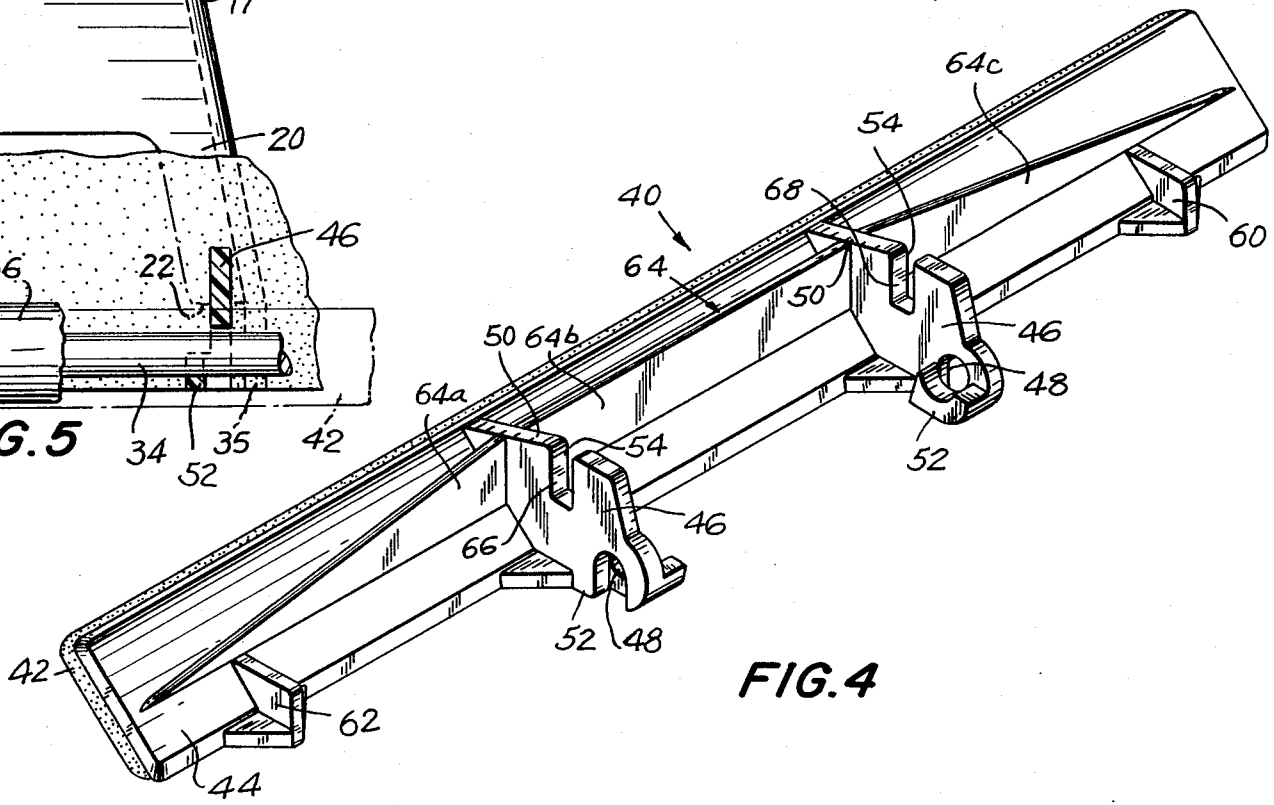
FIG. 4 is a perspective view showing the scrubber attachment of this invention in combination with a scrubber pad attached thereto.

The scrubber attachment 40, best seen in FIG. 4, is in the form of a rigid plastic or sheet metal frame defined by a plate 44 carrying spaced bearing means or ears 46 on one surface, ears 46 being integral parts of plate 44. Each ear is provided with an aperture 48 for the reception of one of the axles 34. Each ear has edges 50 and 52. Edge 50 of each ear 46 is provided with a notch 54 positioned to mate with lower edge 22 of yoke leg 20. (It will be noted that because both legs 18 and 20 have a lower edge 22, the scrubber attachment could be placed on leg 18.) A rigid, non-rotating scrubber results from one of the elongated axles 34 securing both ears 46 to yoke leg 20 and from notch 54 of edge 50 mating with lower edge 22 of yoke leg 20, such a combination serving as a locking means which thereby securely and rigidly fastens scrubber attachment 40 to yoke leg 20. This interlocking of lower edge 22 with the surfaces of each notch 54 prevents rotation or rocking of the scrubber pad assembly 40 about axle 34. The term "rigid" is used herein to mean that the connection of scrubber attachment 40 to yoke 17 is non-rotating. To the extent that manufacturing tolerances or wear result in play between the notches and the edge 22, there may be slight movement between the yoke and the scrubber attachment.

Scrubber attachment 40 also includes reinforcing ribs 60, 62 and 64, the latter having three sections 64*a, b* and *c*. Ribs 60 and 62 are lateral support members which are, when scrubber attachment 40 is mounted on mop head 16, in contact with rollers 36 (best seen in FIG. 3) in order to provide lateral support for scrubber attachment 40. Ribs 60 and 62 and surfaces 66 and 68 support the scrubber attachment during use.

In FIGS. 1 and 2, the mop is illustrated in its normal use position, with the scrubber pad attachment 40 rigidly positioned at one side of and above the sponge 24 and rearwardly of it, considering the sponge face 26 to be the forward or front direction. In FIG. 3, the retracting means 10 has been operated, with rod 30, attached to the illustrated pivoted handle 11, having pulled rigid spine 28 upwardly to thereby wring out the sponge against axles 34 (here carrying rollers 36) carried by the ends of legs 18, 20 of the yoke. (In general, the wringer operation is the same as that illustrated in the noted Wilson U.S. Pat. No. 3,727,259.) This upward motion causes the sponge to be retracted upwardly away from scrubber pad attachment 40 to the position indicated at FIG. 3. As will be seen from FIGS. 2 and 3, while the scrubber pad 42 can be employed with the sponge in either its normal use position or in the retracted position to scrape or abrade the surface being cleaned, the scrubber pad 42 is more exposed when the sponge is retracted. The angle of the face of the scrubber pad 42 with the horizontal is about 15° to about 30°, which provides a preferable angle for scrubbing for a person of ordinary height.

While the present invention has been described by means of the foregoing embodiments, reference should be had to the appended claims for a full definition of the scope of the present invention.

What is claimed is:

1. A scrubber attachment for a sponge mop having an elongated sponge retractably and transversely mounted relative to a yoke, said yoke having leg members for rotatably supporting a pair of elongated parallel axle members between which said sponge may be retracted, said attachment comprising:

a frame;

a scrubber pad attached to said frame so as to be operable from one side of said frame;

bearing means secured to the other side of said frame for, in operation, receiving therethrough one of said axle members;

at least one locking means associated with said leg members for engaging a predetermined portion of said bearing means to secure same to one of said leg members.

2. A scrubber attachment according to claim 1 wherein said bearing means comprises a pair of spaced bearing means.

3. The scrubber attachment of claim 1 wherein said scrubber pad is detachable from said frame.

4. A scrubber attachment according to claim 1 or 2 further comprising at least one cylindrical roller member concentrically mounted on each of said axle members.

5. A scrubber attachment according to claim 4 further comprising at least a pair of spaced lateral reinforcing ribs secured to said other side of said frame.

6. A scrubber attachment according to claim 5 wherein said ribs are outwardly spaced from said bearing means.

7. In a wringer-scrubber mop combination, the mop including a mop head having an elongated sponge, a U-shaped yoke secured to a handle, the yoke having two parallel leg members, each of said leg members having a lower edge, a pair of spaced, parallel and elongated axle members each mounted on a respective leg member, means for retracting the sponge between said two axle members towards said handle for wringing same, a scrubber attachment defined by a frame carrying a scrubber pad, the frame having a pair of apertured ears for receiving one of said axle members therethrough, the improvement comprising means for interlocking said apertured ears to one of said leg members to substantially rigidly mount said frame at a predetermined angle relative to said one of said leg members.

8. The improvement according to claim 7 wherein each of said axles is provided with at least one roller and a portion of said frame abuts one of said rollers when said scrubber pad is in use.

9. The scrubber attachment according to claim 1 or 7 wherein said scrubber pad is of substantially the same length as said sponge.

* * * * *